United States Patent [19]

Huntoon

[11] Patent Number: 5,050,246

[45] Date of Patent: Sep. 24, 1991

[54] FAUCET EXTENDED NUT

[76] Inventor: Howard H. Huntoon, 2940 Park Dr., Jackson, Mich. 49203

[21] Appl. No.: 501,290

[22] Filed: Mar. 30, 1990

[51] Int. Cl.[5] ..... E03C 1/04; F16L 35/00

[52] U.S. Cl. ..... 4/192; 411/432; 411/908; 285/4; 285/356

[58] Field of Search ..... 4/191, 192, 195; 285/4, 285/356, 353, 161; 411/384, 395, 427, 432

[56] References Cited

U.S. PATENT DOCUMENTS 2,523,578 3/1946 Lewis ..... 285/353

2,536,354 6/1946 Cowles ..... 285/357

*Primary Examiner*—Henry J. Recla

*Assistant Examiner*—David Walczak

*Attorney, Agent, or Firm*—Beaman & Beaman

[57] ABSTRACT

A faucet extended nut for both anchoring a faucet to a sink and connecting the faucet to a water supply line under confined conditions. The nut includes an outer extended part adapted to be threadedly rotated on a faucet stem extending through an opening in the sink top to draw the faucet tightly against the upper side of the sink and an inner extended part adapted to be threadedly received within the outer part to force the end of a water supply line into sealing engagement with the stem. Each of the parts are of sufficient length to extend below the sink's bowl, and wrench engaging flats are defined on the lower end of the parts to apply torque to the parts without having to work in the confined area defined between the sink's bowl and the adjacent wall.

10 Claims, 1 Drawing Sheet

60
56
58
46
61
62

76
70
54
49
42
44
72
68
74

48
52

30
22
18
26
24
60
58
28
56
46
40
78
66
49
10
42
64
52
50
72
48
74
68
36
38

34
14
32
30
18
16
24
56
20
10
42
44
12

FAUCET EXTENDED NUT

BACKGROUND OF THE INVENTION

In plumbing systems faucets having a threaded inlet stem are commonly mounted on sinks wherein the stem extends through an opening in the sink and counter and is then connected to a water supply line underneath. Typically, a compression nut is threaded on the stem which when tightened against the lower side of the sink pulls the faucet into firm engagement with the upper side of the sink or counter, and an additional nut threaded on the stem, compresses the head of the water supply line into a sealing engagement with the end of the stem.

In such plumbing systems the sink is usually mounted adjacent a wall and includes a recessed portion or bowl which extends below the faucet's stem defining a confined area between the bowl and the adjacent wall where the work must be performed to rotate the nut. Hence, it is difficult and inconvenient to anchor the faucet to the sink and counter and make the connection of the water supply line to the faucet's stem, even with special tools that are available for rotating the nut or nuts.

It is an object of the invention to provide an extended nut for both anchoring a faucet to a sink counter and for connecting a water supply line to the threaded inlet stem extending from the faucet through an opening in the sink wherein the extended nut obviates the necessity of having to work in the confined area between the sink and adjacent wall during installation and a faucet may be quickly and easily installed without the use of special tools.

Another object of the invention is to provide a faucet extended nut which incorporates inner and outer extended parts wherein the outer part is threaded on the stem of the faucet to pull the faucet tightly against the upper side of the sink or counter as the outer part presses against the lower side and the inner part receives the water supply line and is threadedly received within the outer part to push the end of the water supply line into a sealing engagement with the faucet stem, and each of the parts are provided with a wrench engaging end which extends below the lowest portion of the sink's bowl for conveniently receiving a conventional wrench to transmit torque to the parts.

A further object of the invention is to provide a faucet extended nut which may be readily modified to make the extended nut applicable for a particular installation.

Yet a further object of the invention is to provide a faucet extended nut which may be easily and quickly installed without the use of special tools wherein the nut is of simple construction, economical to manufacture, and is dependable in operation.

In the practice of the invention the faucet extended nut includes an outer extended part and an inner extended part adapted to be received with the outer part. The outer part includes an elongated tubular portion having an adapter attached thereon at one end. Wrench engaging flats are defined on the outer part at the end opposite the adapter, and an axial passage extends through the outer part intersecting a threaded portion adjacent the outer end of the adapter to receive the threaded inlet stem of a faucet. The passage is also provided with threads adjacent the wrench engaging end adapted to engage and couple with threads defined on the inner part.

The inner part consists of a tubular body having an inner end, an outer end and an axial passage extending therethrough intersecting the ends of a diameter sufficient to receive a water supply line. The outer diameter of the inner part is small enough to be received within the outer part's passage. Wrench engaging flats are defined adjacent the outer end, and the inner part is also provided with external threads adjacent the wrench engaging flats adapted to mate with the outer part's threads formed adjacent the end of the adapter.

In a typical application the faucet extended nut of the invention is used for both anchoring a faucet to a sink or counter having a bowl and for connecting a water supply line to the faucet's inlet stem extending through the sink or counter. The outer part is threaded to the faucet whereby the threads of the outer part adapter are mated with the threaded stem. Preferably, the length of the outer part will be sufficient such that the wrench engaging end extends below the lowest portion of the sink's bowl below the confined space defined between the sink's bowl and the adjacent wall. As the outer part is rotated in a tightening direction the outer end of the adapter presses against the lower side of the sink or counter drawing the faucet tightly against the upper side of the sink.

The inner part's passage receives the water supply line whereby an enlarged head defined on the end of the water supply line is disposed adjacent to and adapted to move with the inner end of the inner part which is inserted in the outer part's passage. The inner part is inserted in the outer part's passage and is moved upwardly until the inner part's threads mate with the outer parts internal threads. Applying torque to the wrench engaging end of the inner part in a tightening direction rotates the inner part with respect to the outer part and forces the head of the water supply line upwardly into a sealing engagement with the faucet's stem completing installation of the extended nut.

As the length of the extended nut is sufficiently long to extend below the lowest point of the sink free from the confined area defined between the sink's bowl and the adjacent wall, the wrench engaging ends of the parts are readily accessible for applying a conventional wrench thereto to rotate the parts in a tightening or loosening direction for quick and convenient installation or removal of the faucet and water supply line.

In the disclosed embodiment each of the parts are provided with external annular grooves which serve as guides for shortening the parts to modify the overall length of the extended nut for a particular application. After shortening the adapter is attached to the outer part by bonding.

The faucet extended nut makes installation of faucets easier than heretofore possible as the extended nut permits the work to be performed below the confined area between the sink's bowl and the adjacent wall and without the use of special tools, and, yet, a faucet nut which is of simple construction, economical to manufacture and dependable in use is provided.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

Figures 1, 2, 3, 4, 5:
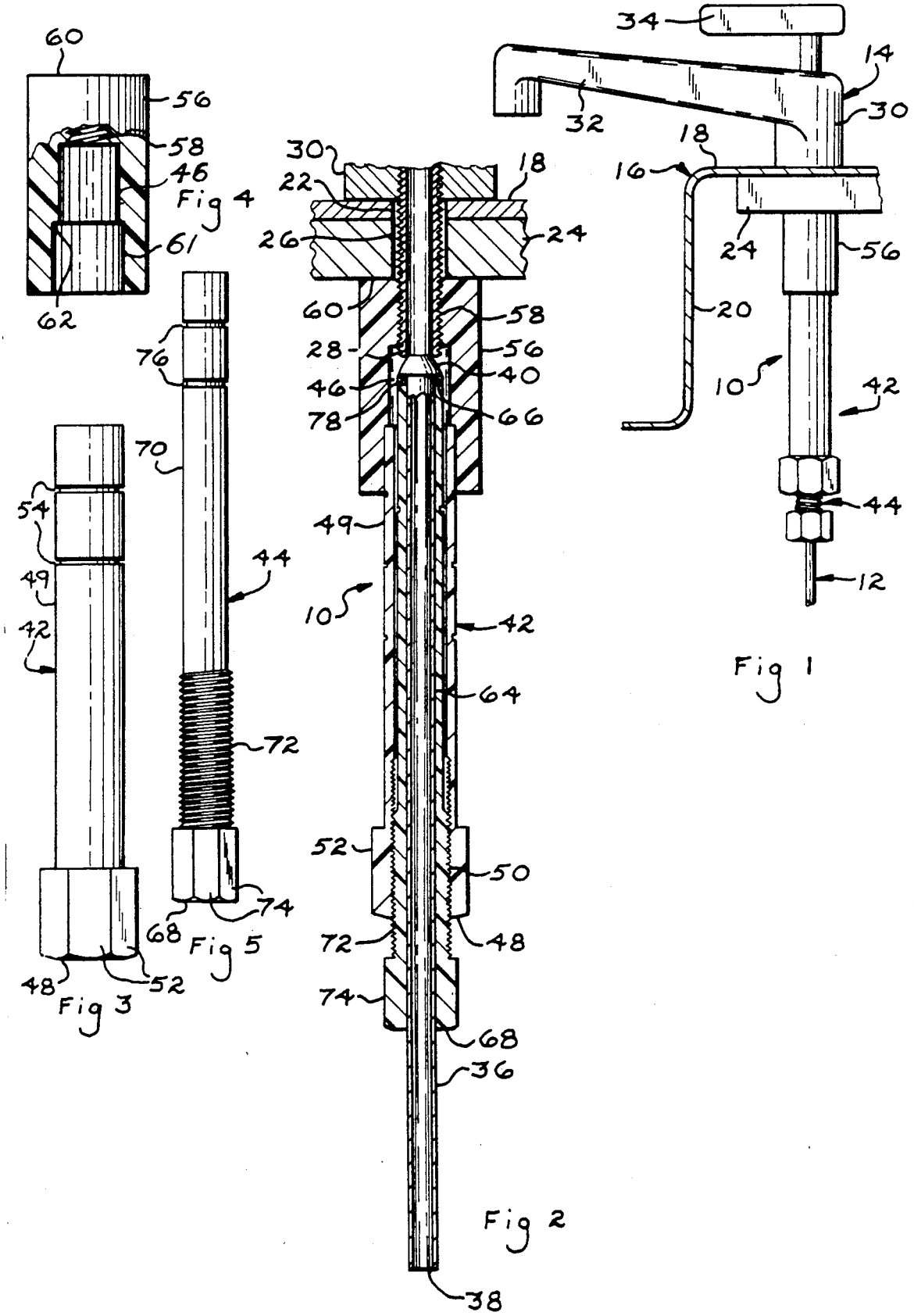
FIG. 1 is an elevational, reduced scale view illustrating the faucet extended nut of the invention employed in a typical application anchoring a faucet to a sink and counter top and connecting the faucet to a water supply line.
FIG. 2 is a diametrical sectional view of the faucet extended nut of the invention connecting a water supply line to a faucet and anchoring the faucet to a sink and counter top.
FIG. 3 is an elevational view of the lower tubular member of the outer extended part before the adapter is attached thereon.
FIG. 4 is an elevational view, partially sectioned, of the adapter.
FIG. 5 is an elevational view of the inner extended part.

In FIGS. 1 and 2 a typical installation is illustrated wherein the faucet extended nut of the invention as generally indicated at 10 is utilized for both connecting a water supply line 12 to a faucet 14 and for anchoring the faucet 14 to a sink 16. The sink 16 includes a sink top 18 and a bowl 20 vertically disposed adjacent an opening 22 formed in the sink top. The sink top 18 is supported on a counter 24 having an opening 26 aligned with the sink's opening 22, and a threaded inlet stem 28 extends from the faucet 14 through the aligned openings to a confined are just below the sink top 18 and between the bowl 20 and a vertical wall to the right of FIG. 1, not shown.

A typical faucet with which the extended nut 10 is utilized with, such as the type indicated at 14 in FIGS. 1 and 2, includes a housing 30 having a base adapted to engage the sink top 18, a water spout 32, and a handle 34 for controlling a valve assembly within the housing 30. A typical water supply line which is connected to the faucet stem 28 with the extended nut 10, such as the type as indicated at 12 in FIGS. 1 and 2, includes a tubular shaft 36 having an end 38 adapted to be connected to a water supply, not show, and the other end includes an enlarged conical head 40 having a diameter greater than the diameter of the shaft 36 adapted to sealingly compress against the end of the stem 28. The faucet extended nut 10 facilitates anchoring the faucet 14 to the sink 16 and connecting the water supply line head 40 to the stem 28 without having to manipulate special tools in the confined area as is necessary with conventional type faucet nuts.

The construction of the faucet extended nut 10 is best appreciated in FIGS. 2–5. The extended nut 10 includes an outer extended part 42 and an inner extended part 44 adapted to be received in the part 42. Both of the parts 42 and 44 are of a simple configuration and are formed of synthetic plastic material. The outer part 42 has an axial passage 46 extending therethrough, and an end 48 is defined on a lower tubular portion 49 through which a threaded bore 50 intersects the end 48 and the passage 46. Wrench engaging flats 52 are defined adjacent the end 48, and annular grooves 54 are formed at predetermined axially spaced locations along the exterior of the portion 49.

The part 42 also includes an adapter 56 which is attached on the tubular portion 49 by bonding. A threaded bore 58 is formed in the adapter 56 adjacent its upper outer end 60 adapted to mate with a threaded faucet stem, and the bore 58 intersects the passage 46. A socket 61 formed in the other end of the adapter intersects the passage 46 and receives the lower tubular portion 49, and an annular shoulder stop 62 defined within the passage 46 limits insertion of the adapter 56 over the portion 49. The outer end 60 of the adapter 56 defines an abutment surface in a plane transverse to the length of the part 42 adapted to engage the lower side of a sink or counter.

The inner part 44 is of a tubular configuration having an axial passage 64 extending therethrough intersecting ends 66 and 68. The forward portion of the part 44 defines an elongated nose 70 which is of sufficient dimension to be received within the passage 46 of the part 42, and external threads 72 defined on the part 44 adjacent the nose 70 are adapted to mate with the threads 50 of the part 42. The part 44 is also provided with wrench engaging flats 74 adjacent the end 68 adapted to receive a conventional wrench or other torque applying device, not shown, to rotate the part 44 with respect to the part 42 and translate the threads 72 on the threads 50. Exteriorly, the part 44 is also provided with annular grooves 76 located at predetermined spaced locations on the nose 70.

To install the extended nut 10 in a typical application, such as to connect a water supply line to a faucet and anchor the faucet to a sink as illustrated in FIGS. 1 and 2, the part 42, which includes the adapter 56 attached to the upper end, is threaded to the faucet 14 whereby the threads 58 mate with the threaded stem 28. Preferably, the overall length of the part 42 will be sufficient such that the end 48 extends below the lowest point of the sink bowl 20 free from the confined area permitting a wrench to be easily applied on the flats 52 for tightening the part 42 to the stem 28. As the part 42 is threaded on the stem 28 the end 60 presses tightly against the lower side of the counter top 24 and the faucet housing 30 is drawn tightly against the upper side of the sink top 18 to anchor the faucet 14 to the sink 16.

After the outer part 42 is mounted to the faucet 14 the end 38 of the water supply line 12 is inserted in the end 66 of the inner part 44 and is passed through the passage 64 and out of the end 68. It is to be appreciated that the dimension of the head 40 is greater than the diameter of the passage 64 preventing the head 40 from being withdrawn from the passage 64, but is less than the diameter of the passage 46 of the outer part 42. Thus, the head 40 will move within the part 42. Desirably, a metal washer 78 will be interposed between the head 40 and end 66 of the inner part 44.

Inserting the nose 70 of the inner part 44 into the end 48 of the outer part and forcing the inner part upwardly moves the head 40 toward the stem 28, and this continues until the threads 72 of the part 44 engage the threads 50 of the part 42. Then, applying torque to the flats 74 and rotating the same in a tightening direction, translates the threads and moves the part 44 further upwardly, and further tightening may be accomplished by applying a conventional wrench to the flats 74 and rotating the part 44 to force the head 40 into a sealing relationship with the stem 28 which completes the installation of the extended nut 10.

If desired, the nut 10 may be easily and quickly removed from the faucet 14, and the water supply line 12 disconnected from the stem 28, by applying a wrench to the flats 52 of the part 42 and rotating the part 42 in a loosening direction until separation of the part 42 from the faucet stem 28 is achieved. However, the part 44 may first be rotated in a loosening direction to disconnect the water supply line 12 from the stem 28 by applying torque to the flats 74 before the part 42 is separated from the faucet 28.

The parts 42 and 44 may be shortened to modify the overall length of the faucet extended nut 10 to make the extended nut 10 applicable for a particular application whereby the grooves 54 and 76 of the parts 42 and 44, respectively, serve as guides for selectively cutting off a desired length from the respective parts. Thus, it is to be appreciated that the adapter 56 will not be attached to the part 42 until the desired length of the extended nut 10 is known, and then the adapter may be attached to the lower section by bonding, as described. It should be noted that the adapter 56 may be homogeneously formed of the material of the part 42 if length adjustment is not desired.

Because the wrench engaging flats of the parts 42 and 44 extend below the lowest point of the sink's bowl, installation and removal of the faucet extended nut may be performed quickly and easily without working in a confined area or requiring special tools. The nut assembly may be removed and reused as desired, and its low cost makes its use economically practical.

It is appreciated that various modifications to the inventive concepts may be apparent to those skilled in the art without departing from the spirit and scope of the invention.

I claim:

1. A faucet extended nut adapted for both anchoring a faucet to a sink and connecting a fluid supply line thereto wherein the faucet includes a threaded stem extending through an opening formed in the sink between opposed spaced sides, and the fluid supply line having a head defined on one end adapted to be compressed into a sealing relationship with the stem, comprising, in combination, an outer elongated part having a first end, a second end, and an axial passage extending therethrough intersecting said first and second ends, a first threaded section defined in said passage adjacent said first end adapted to mate with the faucet's threaded stem, a second threaded section defined in said passage axially spaced from said first end, first torque transfer means defined upon said outer part adjacent said second end for imposing torque upon said outer part about the axial length thereof to rotate said outer part's first threads upon the threaded stem whereby upon rotating said outer part in a tightening direction said first end compresses against one side of the sink drawing the faucet tightly against the opposing side, an inner elongated part adapted to be received within said outer part's passage having an outer end, an inner end axially spaced from said outer end, an axial passage extending therethrough between said inner and outer ends, an exteriorly threaded portion axially intermediate said inner and outer ends adapted to mate with the outer part's second threaded section, said inner part's passage having a diameter sufficient to receive the fluid supply line whereby the head is disposed adjacent to said inner end and adapted to move therewith, and second torque transfers means defined upon said inner part's outer end for imposing torque on said inner part to rotate said inner part with respect to said outer part whereby upon rotating said inner part in a tightening direction said inner end and the supply line head move toward the outer part's first end to force the head into a sealing engagement with the stem received in said outer part.

2. In a faucet extended nut as in claim 1, the sink having a platform having upper and lower sides defining the opposed spaced sides, the opening extending through the platform and the faucet stem protruding below the sink's lower side, and a bowl having a vertical wall disposed in adjacent spaced relation to the stem and extending to a location below the lower end of the stem, said outer part being of a sufficient length such that said second end and said first torque transfer means extend to a location below the lowest portion of the bowl.

3. In a faucet extended nut as in claim 1, wherein said outer part includes an elongated tubular member having ends, a tubular adapter having outer and inner ends attached on one end of said first member at said adapter inner end, said part first end being defined at the outer end of said adapter and said second end being defined at the other end of said tubular member.

4. In a faucet extended nut as in claim 3, wherein said tubular member may be selectively shortened by cutting a desired length from the end opposite said second end before said adapter is attached thereon to modify the length of said outer part for a particular application, and said inner part may be selectively shortened by cutting a desired length from said inner part by cutting through said inner part at a predetermined location between said inner end and said threaded portion thereby forming a new inner end at said cut location.

5. In a faucet extended nut as in claim 4, wherein annular grooves are defined on said tubular member and said inner part at predetermined axially spaced intervals, said annular grooves defining guides for selectively cutting off a desired length of said member or said inner part.

6. In a faucet extended nut as in claim 1, wherein said first and second torque transfer means comprise wrench engaging flats.

7. In a faucet extended nut as in claim 1, the supply line head having a larger dimension than the diameter of said inner part's passage preventing withdrawal of the head from said inner part.

8. In a faucet extended nut as in claim 1, a washer received on the fluid supply line interposed between the head and said inner end.

9. In a faucet extended nut as in claim 1, wherein said inner and outer parts are formed of synthetic plastic material.

10. An extended nut for a threaded faucet stem having a lower end having an annular seat defined thereon for sealing engagement with an enlarged head of a fluid supply line conduit comprising, in combination, an elongated nut having an axial passage and first and second ends, first threads defined in said passage intersecting said first end for receiving the threaded stem, second threads defined in said passage axially intermediate said first threads and said second end, first torque transfer means defined on said nut adjacent said second end, an elongated compression tube within said nut passage having an axial passage adapted to receive a fluid supply conduit having a head and a first end adapted to directly abut the fluid supply conduit head for maintaining the conduit head in sealed engagement with the stem annular seat, threads defined on said tube engaging said nut second threads, said tube having a second end axially extending beyond said nut second end, and second torque transfer mean defined on said tube second end for rotating said tube within said nut.

* * * * *